US007320533B1

(12) United States Patent
Beadle

(10) Patent No.: US 7,320,533 B1
(45) Date of Patent: Jan. 22, 2008

(54) IN GROUND LIGHTING FIXTURE WITH ADJUSTABLE LAMP

(76) Inventor: Joshua Z. Beadle, 4890 Del Mar Mesa Rd., San Diego, CA (US) 92130

( * ) Notice: Subject to any disclaimer, the term of this patent is extended or adjusted under 35 U.S.C. 154(b) by 118 days.

(21) Appl. No.: 11/367,673

(22) Filed: Mar. 3, 2006

(51) Int. Cl.
*F21V 19/02* (2006.01)

(52) U.S. Cl. ..... 362/285; 362/425; 362/427; 362/428; 362/419; 362/287; 362/220

(58) Field of Classification Search ..... None
See application file for complete search history.

(56) References Cited

U.S. PATENT DOCUMENTS

| | | | | |
|---|---|---|---|---|
| 4,180,850 | A | 12/1979 | Bivens | |
| 5,003,441 | A | 3/1991 | Crowe | |
| 5,072,345 | A | 12/1991 | Goggia | |
| 5,156,454 | A | 10/1992 | White | |
| 5,230,559 | A | 7/1993 | Porter et al. | |
| 5,408,397 | A | 4/1995 | Tyson | |
| 5,414,607 | A | 5/1995 | Harris et al. | |
| 5,481,443 | A | 1/1996 | Wagner et al. | |
| 5,486,988 | A | 1/1996 | Tyson | |
| 5,727,873 | A | 3/1998 | Tyson | |
| 5,743,622 | A | 4/1998 | Ibbitson et al. | |
| 5,908,236 | A | 6/1999 | Lueken et al. | |
| 6,106,134 | A * | 8/2000 | Bomas | 362/153.1 |
| 6,491,407 | B1 | 12/2002 | Beadle | |

* cited by examiner

*Primary Examiner*—Sandra O'Shea
*Assistant Examiner*—Kristen A Manskar
(74) *Attorney, Agent, or Firm*—Procopio, Cory, Hargreaves & Savitch LLP; Eleanor M. Musick

(57) ABSTRACT

The in-ground, or "well light", fixture comprises a hollow cylindrical housing with an angled end and an flat end, a lamp assembly easily mounted at either end, and a baffle. The lamp assembly is rotatably and vertically adjustable within the housing and either the angled end or the flat end may be placed upward by virtue of a pair of channels extending down the length of the housing. Fasteners are provided on the lamp assembly for attaching one or more filters above the lamp face and to create a protective air gap that prevents debris from accumulating on the lamp.

19 Claims, 7 Drawing Sheets

IN GROUND LIGHTING FIXTURE WITH ADJUSTABLE LAMP

FIELD OF THE INVENTION

The present invention relates to lighting fixtures for landscape and environmental lighting applications and, more particularly, to in-, or below-ground lighting fixtures.

BACKGROUND OF THE INVENTION

The use of outdoor lighting fixtures has become increasingly popular for illuminating buildings, gardens, pathways, and entrance ways as the nighttime play of light on the landscape and exterior structures is aesthetically pleasing. Additionally, such lighting provides enhanced security by reducing eliminating dark hiding places and unobserved entry points for intruders. The most widely used outdoor lighting systems include one or more low voltage lighting fixtures that are connected to a 12 V transformer that is, in turn, connected to a standard 120 VAC line. Each lighting fixture generally includes a housing, a lamp assembly having a halogen lamp or conventional bulb and a reflector, and a lens or window. Many configurations are known for providing a variety of different lighting effects.

Landscape lighting fixtures, most of which are mounted at or above ground level can be considered to appear somewhat incongruous with the surrounding vegetation during daylight hours, when the illumination function is not in use. Further, because of the constant exposure to the elements, above ground lighting fixtures are generally required to be made of expensive, high quality materials, such as non-corrosive metal alloys, in order to provide durability and a reasonable resistance to damage so as not to appear cheap and unkempt.

As an alternative to the above-ground placement of landscape lighting fixtures, recessed, in-ground lighting fixtures, also known as "well lights", have gained widespread acceptance. In certain applications, the use of below-ground landscape lighting is preferable over above-ground varieties, especially in areas surrounding walkways where an above-ground element could poses a tripping hazard or in lawn areas where the use of a lawn mower presents a risk of damage to the fixture. One such in-ground lighting fixture is described in U.S. Pat. No. 6,491,407 of Beadle, which is incorporated herein by reference.

A problem experienced with below-ground light fixtures is the limited ability to control the direction of illumination efficiently and easily due to the limited range of illumination and convenient access to the lamp. It would be an advantage to have an apparatus in which the lamp is easily accessible to the user for adjustment of beam quality and direction of the fixture.

Some existing lighting fixtures are designed to be placed in the ground with their faces parallel with the ground. Others fixtures have their upper edge cut at an angle, so that the exit window is at shallow angle relative to the ground, with one side of the fixture extending slightly above the ground. The fixture is selected according to the position of the exit face—there is no variability once the fixture is selected, short of digging the hole in the ground at a different, non-vertical angle, which tends to be imprecise.

Most well lights have a grating over the exit face, which protects the lamp from impact while permitting air to enter the housing. A significant problem with many well lights is the fire hazard that is created when dried plant debris builds up on the lens of the hot lamp. Occasionally, the gratings are removed because they are either broken or the block too much light to achieve the desired effect. This increases the risk of fire because more and larger plant debris can build up on the hot lamp.

The need remains for an in-ground lighting fixture that provides variability in the position of the lamp to provide better control and more efficient use of the light beam, and that greatly reduces the fire hazard caused by build-up on the hot lamp. The present invention is directed to such a fixture.

SUMMARY OF THE INVENTION

It is an advantage of the present invention to provide a single in-ground lighting fixture that can be placed in the ground to emit a beam that is either directed upward, perpendicular to the ground surface, or angled.

It is a further advantage of the present invention to provide an in-ground lighting fixture that allows multi-axis adjustment of the beam.

Still another advantage of the present invention is to provide one or more protective lenses that prevent build up of debris on the lamp face to reduce fire hazards commonly associated with well lights.

In an exemplary embodiment, the in-ground, or "well light", fixture comprises a hollow cylindrical housing with a first, flat end and a second, angled end. Either the flat end or the angled end can be used as the upper end depending on the preference of the user and the purpose for which the lighting fixture will be used.

In the preferred embodiment, the lamp assembly includes a pair of pivots that extend from diametrically opposite sides of the assembly, where each pivot has a circumferential edge that is configured to slide within a channel running along the length of the housing. The combination of the pivot edges and their corresponding channels allows the lamp assembly to be positioned near either end of the housing depending on whether the fixture is to be installed with the angled or flat end up. The same combination of the pivots and the channels forms a gimble for varying the angle of the lamp assembly within the housing. The use of the flat end or angled end of the housing and the adjustability of vertical position and the angle of the lamp assembly provide the maximum flexibility with a single fixture.

The lamp assembly comprises an enclosure with a base and an upper ring that retains the lamp within the assembly. The upper ring has threads on its inner sidewall that mate with threads on the outer surface of the upper edge of the base to enclose the edges of the lamp. The lamp is preferably a sealed beam PAR lamp, but may be a combination of a halogen lamp, a parabolic reflector and a window or lens disposed over the lamp and held in place by the upper ring to enclose and protect the lamp against contaminants. The lamp assembly is preferably watertight. A socket is located within the base for providing electrical connection between the lamp and wires that are fed through the wall of the base.

O-rings or similar resilient materials disposed on the pivot heads retain the lamp assembly at the desired height and angle within the housing by providing resistance against movement within the channels.

A baffle is attached at the upper end of the housing to protect the lamp assembly against physical contact, to permit airflow within the housing and to reduce glare from the lamp. The baffle may be held in place by an interference fit or by forming threaded bores in the housing the light deflector snaps onto ether end of the housing. The baffle may alternately be attached to the housing end by screws.

The housing may be formed from polyvinylchloride (PVC), plastic or other durable, corrosion-resistant polymer. The baffle may be formed from brass, anodized or powder-coated aluminum, high impact plastic or any other material that provides appropriate durability and weather-resistance as well as being aesthetically pleasing. The lamp housing is preferably formed from high temperature plastic.

BRIEF DESCRIPTION OF THE DRAWINGS

The present invention will be more clearly understood from the following detailed description of the preferred embodiments of the invention and from the attached drawings, in which.

DETAILED DESCRIPTION OF THE PREFERRED EMBODIMENTS

As illustrated in FIGS. 1-5, the in-ground lighting fixture 10 includes a cylindrical housing 100, a lamp assembly 200, and a light deflector or cover 300.

Figure 1:
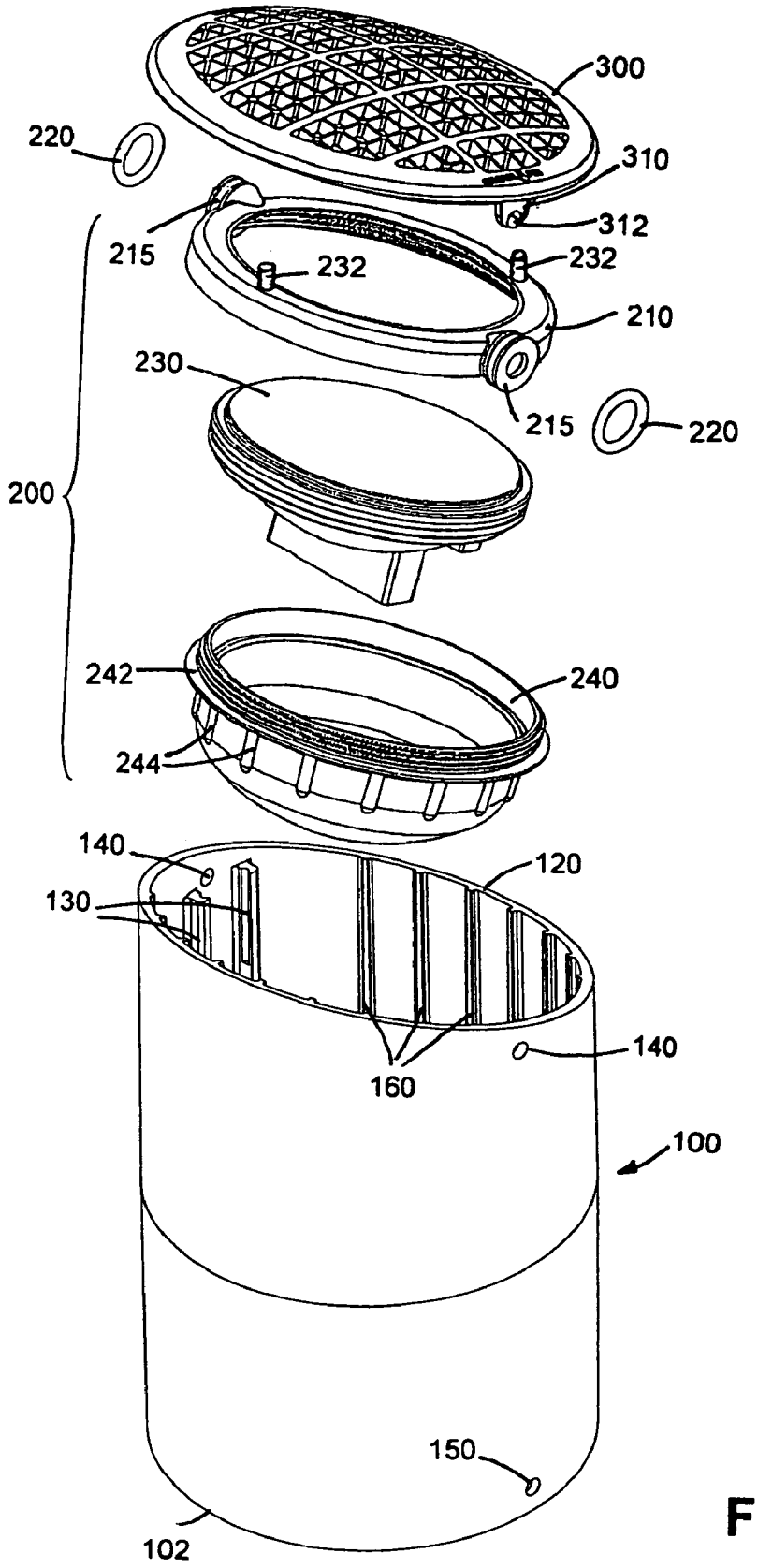
FIG. 1 is an exploded perspective view of the in-ground lighting fixture.
Figure 2:
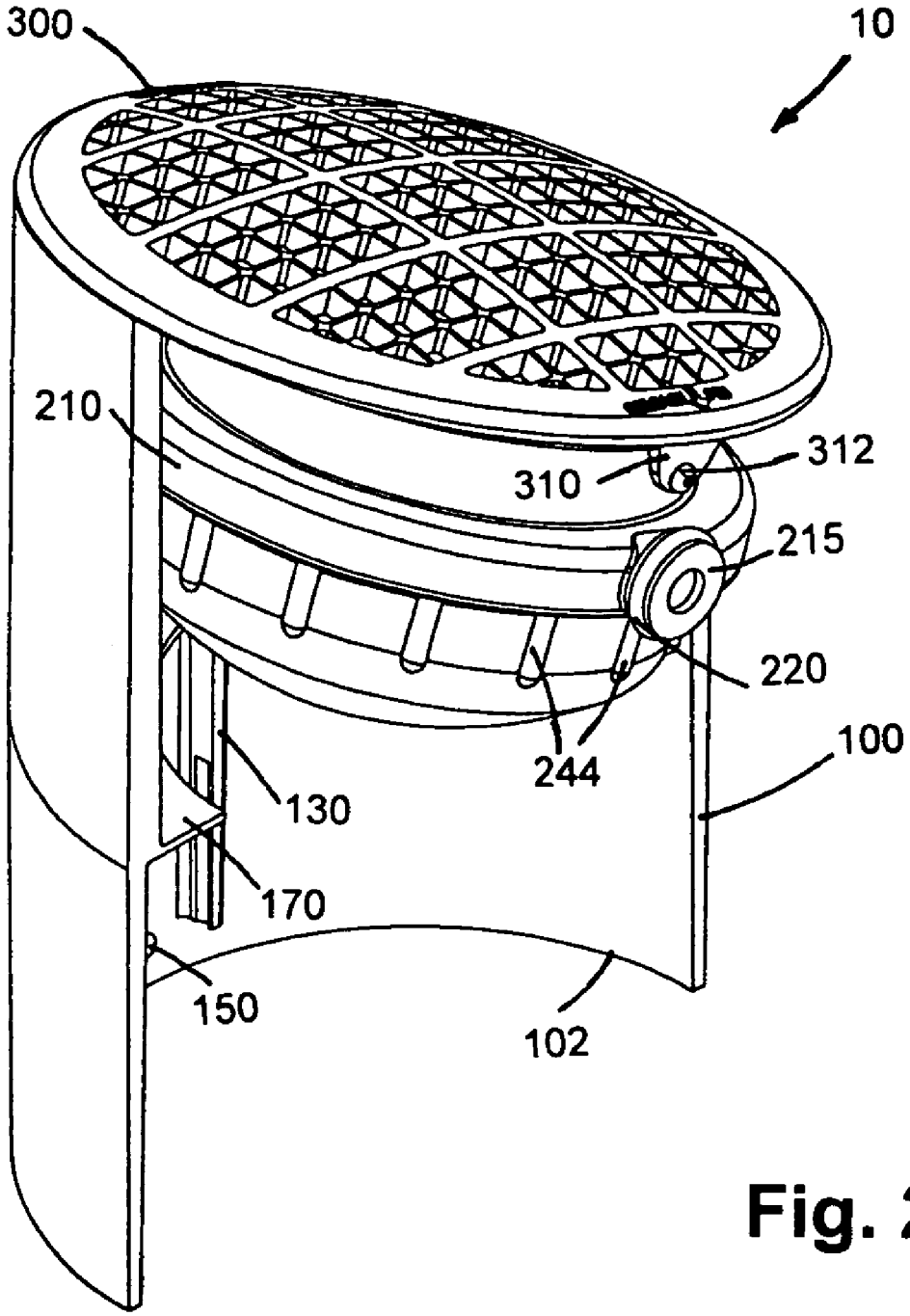
FIG. 2 is perspective view of the fixture with the housing partially cut away.
Figure 6A:
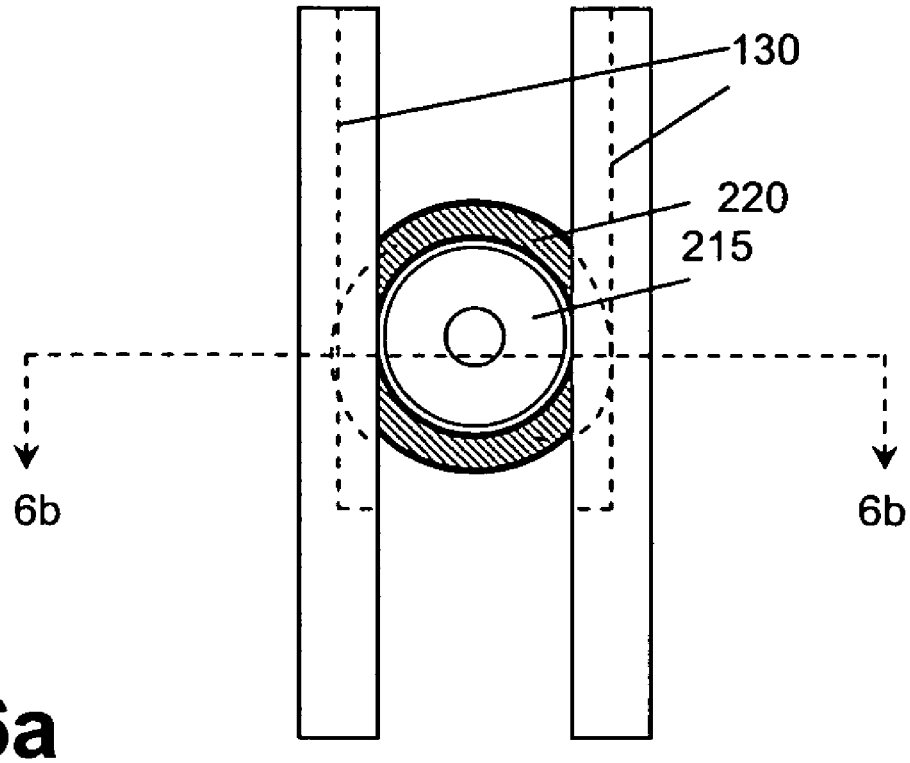
FIG. 6*a* is a diagrammatic side view showing the interaction between a pivot and a channel according to the present invention, and FIG. 6*b*. is a cross-sectional view of the pivot and channel taken along line 6*b*-6*b* of FIG. 6*a*.
Figure 6B:
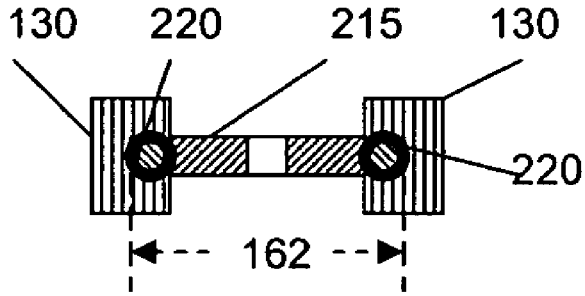

The cylindrical housing 100 has a first, flat end 102, a second, angled end 120, an outer diameter, and an inner diameter. Housing 100 may be formed from polyvinylchloride (PVC), polymer, plastic or similar materials that are resistant to corrosion and oxidation. In the preferred embodiment, housing 100 is injection molded from a thermoplastic polyester resin such a Valox®. Two channels 130 extend vertically (longitudinally) at diametrically opposite locations of the inner surface of the housing. Each channel 130 is formed from a pair of rails with arced or shallow C-shaped depressions on their inner faces to define a channel spacing 162, as seen in FIG. 6*b*, which generally corresponds to the outer diameter of O-ring 220. The channels 130 are preferably formed integrally with the housing, for example, during a injection molding process. Additional ribs 160 may also be formed to enhance the structural strength of the housing 100, either extending the entire length of the housing, or for a portion of the length, for example, as illustrated in FIG. 2. It is important to retain the circular cross-section of the housing to ensure uniformity of the space between the channels. When the housing is formed by injection molding, a relatively thin, inwardly extending annular ring 170 is formed at the lengthwise (vertical) center of the housing to help retain circular rigidity as the material cools. The channels 130 and optional ring 170, if not injection molded, may be made of plastic or metal and may be added later and attached to the inside diameter of the housing 100 with a commercially available adhesive, or attached by screws, or by any other suitable means.

Cover 300 is circular in shape with an area of sufficient size to fit over and cover the upper edge of the housing 100 to enclose the housing. Because the area to be covered when the angled end is up is larger, if a single baffle is to be provided to cover either end, the baffle diameter will be slightly larger than the diameter of the housing. Cover 300 may be flat, but preferably has a convex surface, with a waffle pattern of alternating openings and ridges that transmit light emitted from the fixture that is generally perpendicular to the beam direction while blocking scattered light to reduce glare. Tabs 310 extend downward from the outer edge of cover 300 to align with openings 140 or 150 near the angled and flat ends, respectively, for attachment of cover 300 to housing 100. Tabs 310 may have openings through which a screw or pin may be passed to mate with openings 140 or 150, as appropriate, or a bump 312 may be formed on the inner surface of the tab so that the bump snaps into 140 or holes 150 when they are aligned. Cover 300 may be formed from a high-impact, injection molded plastic or thermoplastic polyester resin such as Valox®, but may also be made of a metal such as brass, anodized or powder-coated aluminum, or other suitable material. The lower edge of cover 300 has an annular ring with an outer diameter that fits closely within the inner diameter of housing 100.

The lamp assembly 200 comprises a retaining ring 210, a lamp housing 240, and a lamp 230. The lamp 230 is commercially available and has conductors for attachment of wires connected to a voltage source, a generally parabolic reflector, and an emitting portion. In the preferred embodiment, the lamp is a sealed PAR (parabolic aluminized reflector) lamp, typically a PAR-36 lamp, with a halogen tube or incandescent filament. Alternatively, an open reflector type lamp, such as a MR-16 halogen lamp, may be used by positioning a lens to enclose and seal the reflector. The base of lamp 230 is retained within lamp housing 240, which at its upper edge has an external thread to mate with an internal thread in the inner surface of retaining ring 210.

Lamp housing 240 is generally bowl shaped and encloses a connector (not shown) to which the lamp conductor is connected. A flange 242 formed just below the threaded upper edge abuts the lower edge of retaining ring 210 when two parts are assembled. Optional ribs 244 are formed in a ring around the outer surface of the lamp housing to facilitate grasping the lamp assembly when the assembly needs to be opened to replace the lamp or for repair. In the preferred embodiment, the lamp housing 240 is formed from high temperature plastic, polymer or thermoplastic polyester resin, preferably formed by injection molding.

Lamp housing 240 includes conductors or a pass-through opening for conductors, e.g., wire, (not shown) for providing electrical contact between the socket and a voltage source. It may be desirable to fill the lower portion of the housing 240 with a potting material to surround and seal the socket to prevent moisture intrusion. The lamp housing provides a significant advantage of currently commercially-available well lights, in which the contacts on the back of the lamp are typically exposed. Because the upper surface of the fixture is not sealed, water from rainfall or from irrigation builds up within the housing. When the water level in the housing gets high enough to reach the contacts, it will create a short circuit that interferes with proper operation of the lamp. The sealed lamp housing 240 protects the lamp contacts from water the collects in the fixture housing.

Retaining ring 210 has an inner diameter forming a lip to hold the lamp 230 in place while being sufficiently open to avoid blocking the light from the lamp 230. Two circular pivots 215 extend from the outer edge of ring 210 at diametrically opposite locations to define a rotational axis for gimbled operation. Each pivot 215 has a channel formed around its circumferential edge for receiving an O-ring 220. The material of which the O-ring is formed should be resilient and sufficiently soft to generate friction when in contact with the surfaces of the C-shaped depressions of channel 130. The diameter and thickness of O-ring 220 are selected to closely fit the arc of channel 130 so that the pivot 215 will slide vertically and pivot within channel 130 with resistance. The resistance should be sufficient to hold the lamp assembly in position unless force is intentionally applied by someone who may be installing or adjusting the fixture.

In the preferred embodiment, the retaining ring 210 is formed from high temperature plastic, preferably by injection molding. Alternatively, the retaining ring 210 may be made of other injection molded plastics or polymers or formed from metal such as brass, copper, stainless steel or coated metal, or any other suitable materials that are resistant to corrosion and oxidation.

In the preferred embodiment, the pivots 215 are formed integrally with the retaining ring 210. Alternatively, the pivots may be separate pieces that are screwed into or otherwise attached to the ring. In an alternate embodiment, the pivots 215 may be attached to and extending from the outer surface of base 240 as opposed to ring 210. Optional bosses or pegs 232, or other appropriate fasteners may be attached to the outer surface of retaining ring 210 to retain one or more filters (not shown) over the lamp 230. The filter(s) will have notches configured to mate with the bosses to hold the filter in place. The filter (not shown) is preferably formed from a high temperature plastic such as Lexan® and may be colored or textured to achieve a desired lighting affect.

Figure 3B:
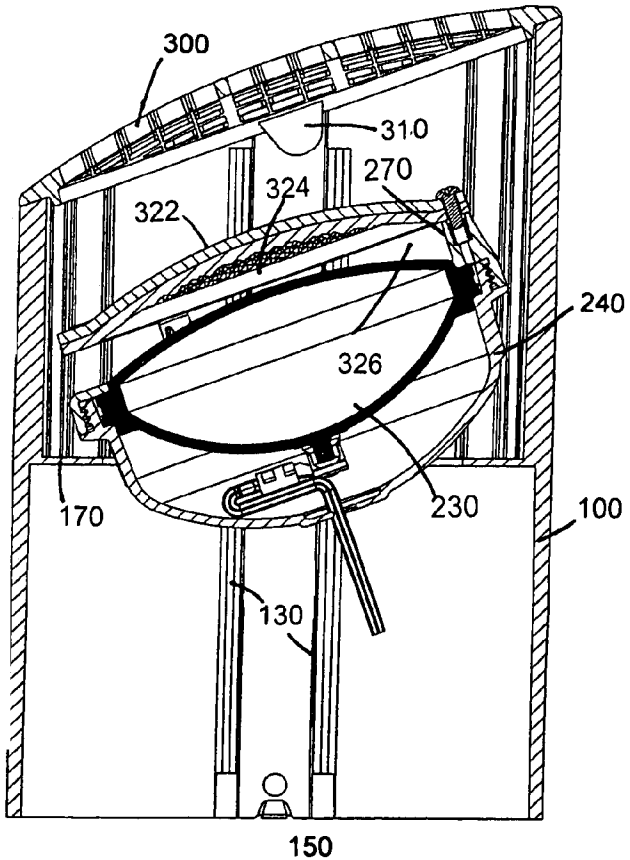
FIG. 3*b* is a cross sectional view taken along line A-A of FIG. 3*a*.
Figure 3A:
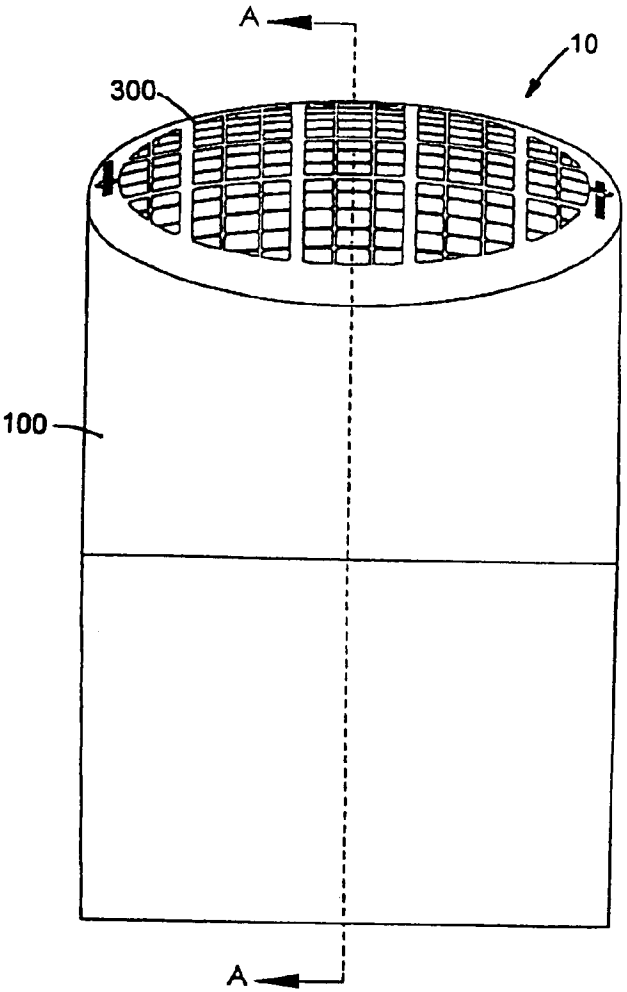
FIG. 3*a* is a front elevation of the fixture with the fixture with the angled edge up.
Figure 7:
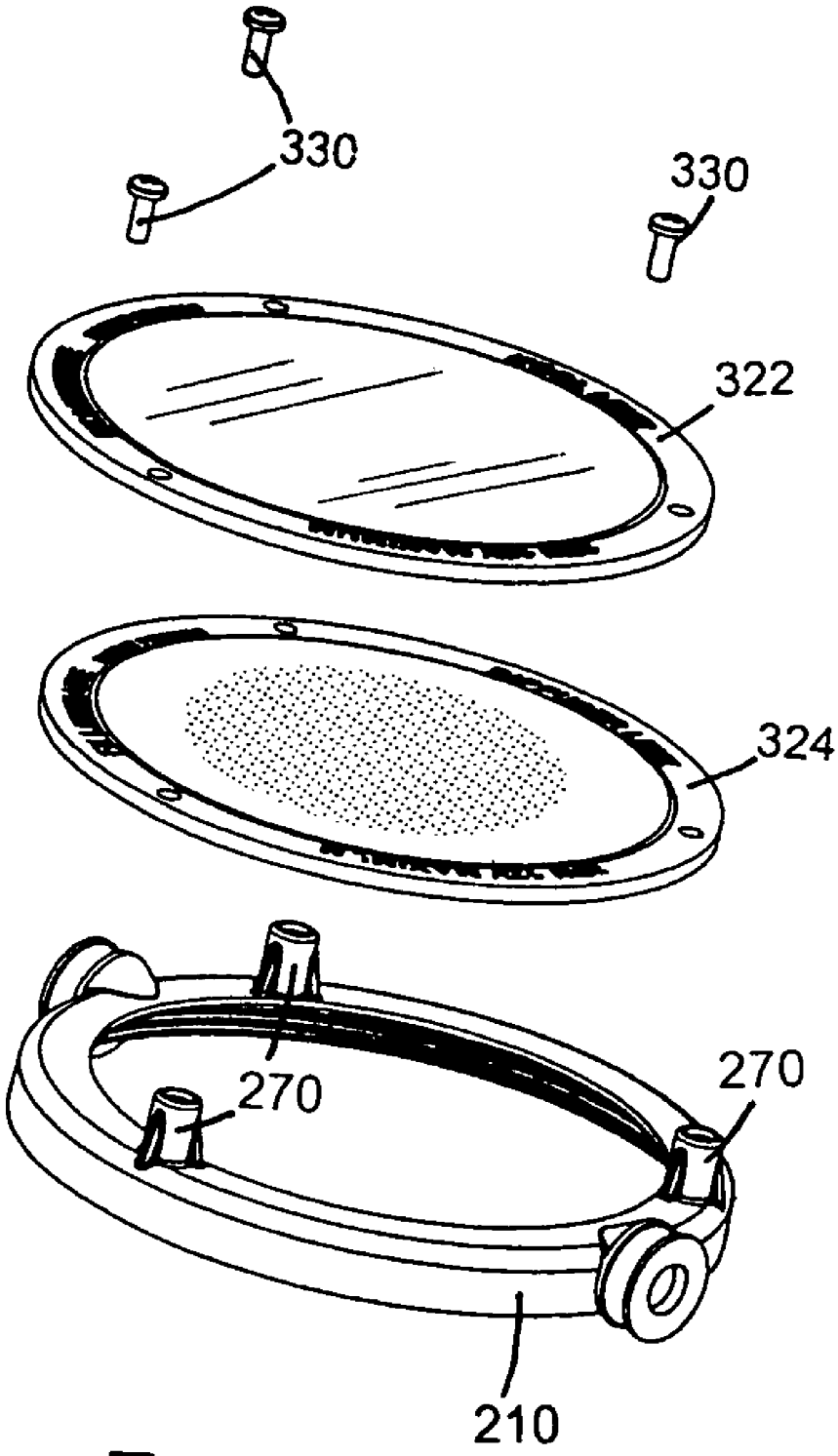
FIG. 7. is an exploded perspective view of the protective lens assembly of one embodiment of the invention.

FIGS. 3*b* and 7 illustrate a preferred arrangement for providing filters over the lamp face. Retaining ring 210 has multiple bosses 270 extending upward to support one or more filters. Each boss has a bore for receiving a fastener 330, which may be a screw or peg. As illustrated, filter 324 is a diffuser lens formed from Lexan® or other high temperature plastic. Openings are made near the perimeter of the lens at the same radial spacing as bosses 270, so that a fastener 330 can be inserted through each opening and into the bore in boss 270. In the preferred embodiment, the bore in boss 270 is threaded and fastener 330 is a screw. Filter 324 is preferably textured, which can be seen clearly in FIG. 3*b*, with small prisms that refract the light from the lamp to spread the beam. This is advantageous because PAR lamps tend to project narrow beams, while the desired lighting affect for landscape purposes is usually a diffuse, spreading beam. Filter 322 sits on top of filter 322 and is typically a color filter, the color of which can be selected to enhance the color of the object being illuminated. For example, where plants are being lit, a blue filter will be used to remove the orange tones that are common in PAR lamps and which tend to make green plants look unhealthy. Filter 322 also has openings to match the radial spacing of the bosses so that fastener 330 serves to hold both filters in place. Preferably, the two filters have matching curvatures so that they fit closely together. Additional filters may added to the stack for additional lighting affects.

The heights of the bosses 270 are selected to act as spacers that define a spacing 326 (shown in FIG. 3*b*) between the face of lamp 230 and the lower surface of lens 324. Spacing 326 provides an air gap to permit air flow around the lamp while the lamp is protected against debris build-up. With the protective lens assembly over the lamp, even if the cover 300 were to be damaged or removed, a hot lamp would not create a fire hazard because it would not come in contact with debris.

Figure 4A:
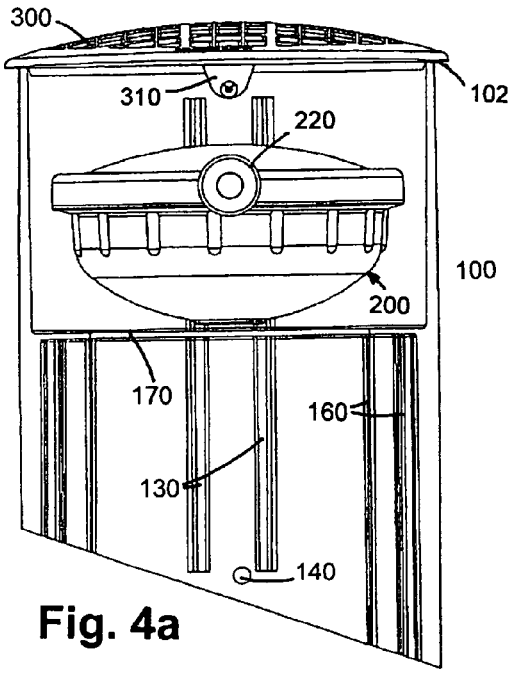
FIGS. 4*a*-4*d* are perspective views of the in-ground lighting fixture with the angled edge up showing the lamp assembly at two different heights and a perpendicular light direction (FIGS. 4*a* and 4*b*) and two different heights with an angled light direction (FIGS. 4*c* and 4*d*).
Figure 4B:
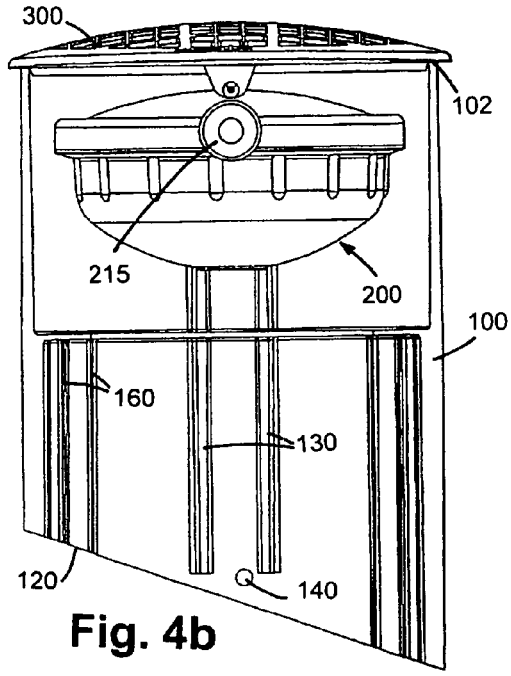
Figure 4C:
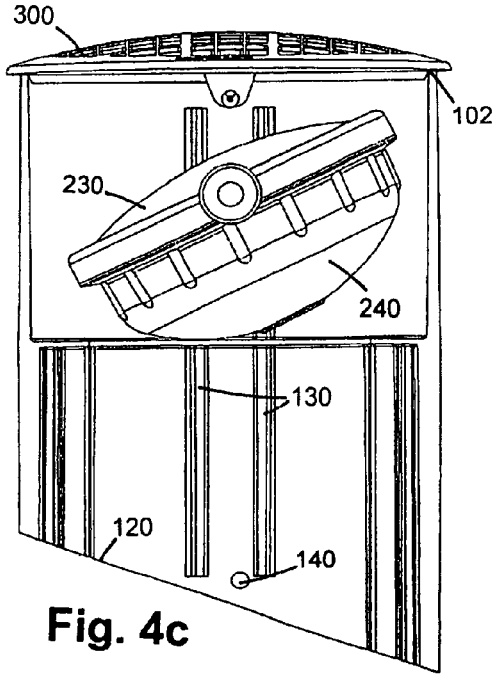
Figure 4D:
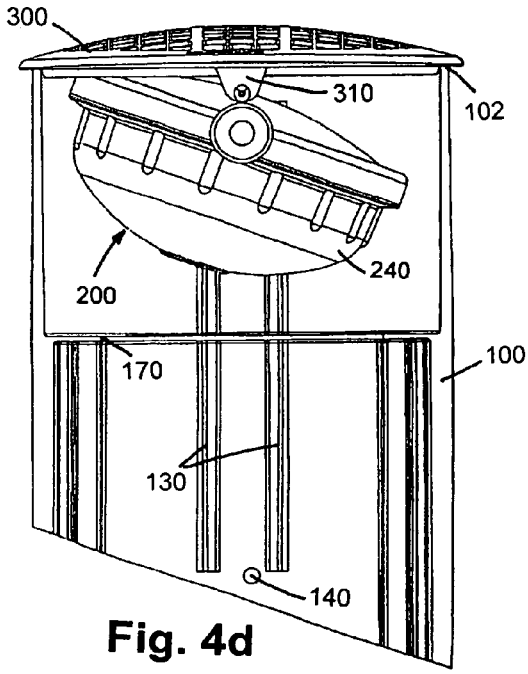
Figure 5A:
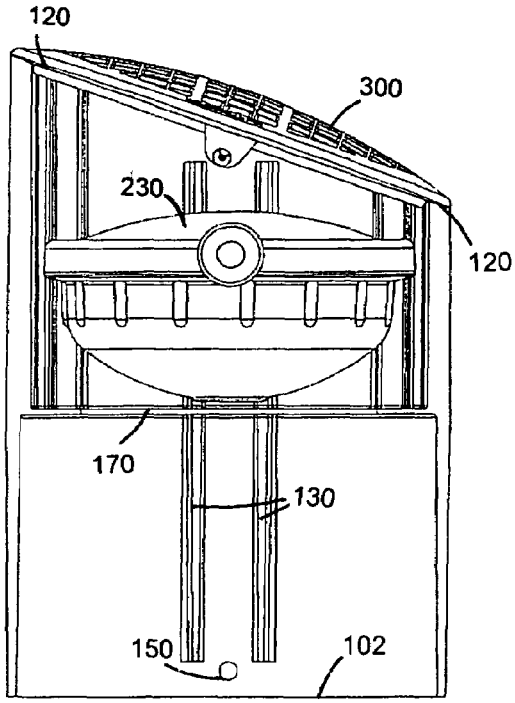
FIGS. 5*a*-5*d* are perspective views of the in-ground lighting fixture with the flat edge up showing the lamp assembly at two different heights and a perpendicular light direction (FIGS. 5*a* and 5*b*) and two different heights with a angled light direction (FIGS. 5*c* and 5*d*).
Figure 5B:
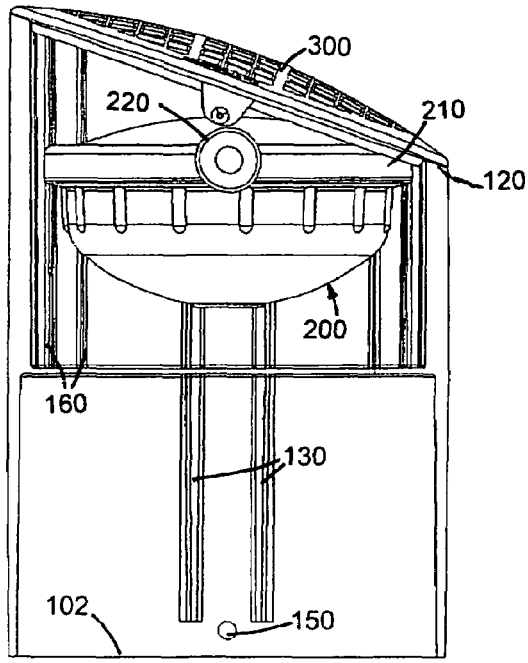
Figure 5C:
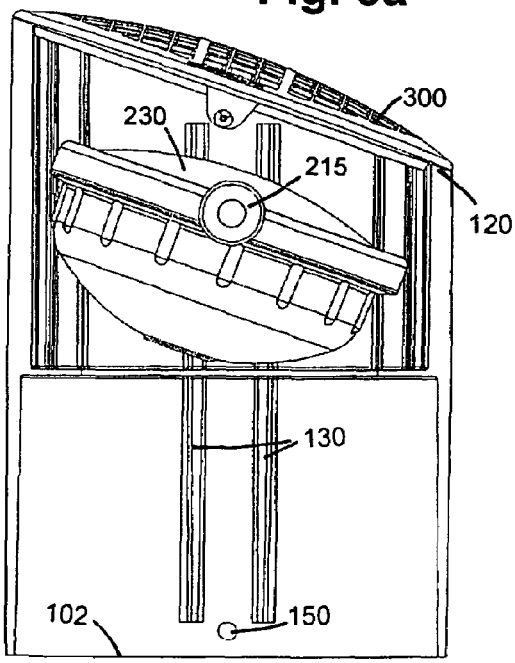
Figure 5D:
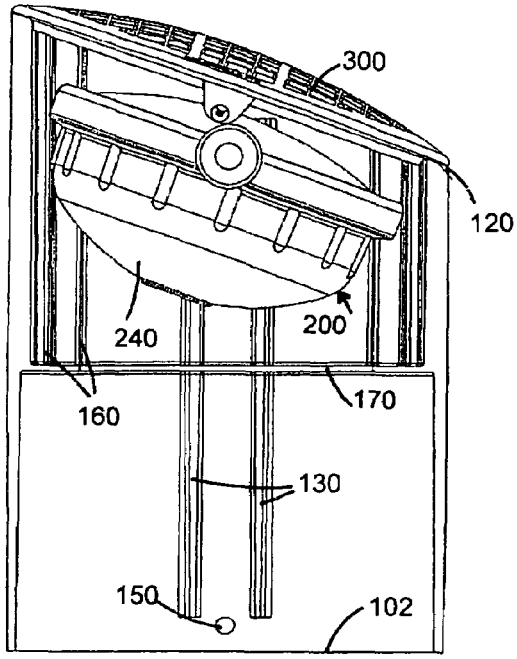

FIGS. 4*a-d* and 5*a-d* illustrate the two orientation options for the housing, FIGS. 4*a-d* show the housing oriented with the angled end 120 up and the flat end 102 down, while FIGS. 5*a-d* show the opposite installation. FIGS. 4*a* and 5*a* show the lamp assembly 200 situated to project light straight upward with the assembly set back from the upper edge of the fixture, so that the light is more diffuse. FIGS. 4*b* and 5*b* show the lamp assembly again aimed straight upward, but the assembly is closer to the upper edge of the fixture, so that the light is more focused. FIGS. 4*c* and 5*c* illustrate the lamp assembly 200 at an angled orientation relative to the ground surface, i.e., not perpendicular to the center axis of the housing, with the assembly 200 set back from the upper edge to achieve a more diffuse light beam. FIGS. 4*d* and 5*d* show the lamp assembly angled and positioned closer to the upper edge to project a more focused beam at an angle relative to the housing axis.

When the in-ground lighting fixture is ready to be placed into a hole in the ground, the user selects the configuration he or she desires depending on the lighting application. The user removes the cover 300 from the housing 100 to provide access to the lamp assembly 200. Assuming that the pivots 215 of the lamp assembly 200 are already retained within the channels 130 near the flat end 102, if the user wishes to place the angled end up, he or she slides the pivots 215 toward the flat end and completely out of the channels. The housing is then flipped over and the pivots inserted into the channels from the angled end 120 and slid to the desired height and angle within the housing. Similarly, if the lamp assembly 200 is always positioned within the angled end 120, the assembly is pulled upward to release the pivots 215 from the channels 130. The housing is flipped over and the pivots 215 are then inserted into the channels from the flat end.

For installation, the housing 100 is placed in the desired orientation (flat end or angled end up) into a hole in the ground into which appropriate conductive cable has been run. The cable ends are pulled up so that there is sufficient slack in the cable to permit manipulation for connection to the lamp assembly 200. The conductors (not shown) that extend from the base of lamp assembly 200 are connected to the cable conductors using appropriate connectors. The pivots 215 are then inserted into their corresponding channels and slid to the desired height within the housing. The lamp assembly is rotated around the pivots to attain the desired angle, after which the cover 300 is attached to the upper edge.

It should be noted that while the housing will usually be cylindrical for ease of manufacture and installation, the shape of the baffle is not so limited, and different geometric shapes, e.g., square, pentagonal, hexagonal, etc., may be utilized to achieve a particular aesthetic effect.

The in-ground lighting fixture of the present invention offers wide directional variability with the entire fixture designed and adapted for in-ground use. The configuration of the present invention is aesthetically pleasing and is constructed with a focus on simplicity of use, ease of adjustment, and durability of construction.

Other embodiments and modifications of the present invention may occur to those of ordinary skill in the art in view of the se teachings. Accordingly, the invention is to be limited only by the following claims which include all other such embodiments and modifications when viewed in conjunction with the above specifications and accompanying drawings.

We claim:

1. A lighting fixture, comprising:

an elongated housing having a flat end, an angled end, and an inner surface having a pair of channels disposed on diametrically opposite sides of the housing and extending along a length of the housing, each pair of channels having a pair of opposing depressions defining a channel gap at each of the angled end and the flat end;

a lamp assembly comprising:

a retaining ring having a pair of circular pivots extending therefrom, each pivot having a circumferential edge that fits within the channel gap so that the lamp assembly is retained at a set angle and height within the housing by frictional resistance between the circumferential edge of the pivot and the channel gap, wherein application of a rotational force to the retaining ring causes the lamp assembly to pivot within the channel gap and wherein application of a vertical force causes the pivots to slide within the channel gap;

a lamp housing releasably attached to the retaining ring, the lamp housing having a conductor means for connection to a voltage source; and a lamp retained within the lamp housing.

2. The lighting fixture of claim 1, further comprising a resilient O-ring disposed around the circumferential edge.

3. The lighting fixture of claim 1, wherein the lamp comprises a sealed PAR lamp.

4. The lighting fixture of claim 1, further comprising a cover having a plurality of openings for transmitting light.

5. The lighting fixture of claim 1, wherein the retaining ring further includes fastening means for retaining one or more filters over the lamp.

6. The lighting fixture of claim 5, wherein the fastening means comprises spacers for defining an air gap between the one or more filters and a face of the lamp.

7. The lighting fixture of claim 5, wherein the one or more filters comprises a diffuser and a color filter.

8. The lighting fixture of claim 1, wherein the elongated housing is an injection-molded thermoplastic polyester resin.

9. The lighting fixture of claim 8, wherein the pair of channels is formed integrally with the elongated housing.

10. The lighting fixture of claim 1, wherein the retaining ring and lamp housing are formed from an injection-molded thermoplastic resin.

11. The lighting fixture of claim 4, wherein the cover is formed from an injection-molded thermoplastic resin.

12. An in-ground lighting fixture, comprising:

a tubular housing having a flat end, an angled end, and an inner surface having a pair of longitudinal channels disposed on diametrically opposite sides of the housing near each of the flat end and the angled end, each pair of channels having a pair of opposing depressions defining a channel gap;

a lamp assembly for retaining a lamp within the housing, the lamp assembly having a pair of circular pivots extending therefrom, each pivot having a circumferential edge that fits within the channel gap so that the lamp assembly is retained at a set angle and height within the housing by frictional resistance between the circumferential edge of the pivot and the channel gap, wherein application of a rotational force to the lamp assembly causes the lamp assembly to pivot within the channel gap and wherein application of a vertical force causes the pivots to slide within the channel gap;

wherein the tubular housing is disposed in the ground with one of the flat end and the angled end oriented upward and the other down, and wherein the lamp assembly is slid within the pair of channels so that it is disposed near whichever end is oriented upward; and a cover releasably attached to the housing at whichever of the flat end and the angled end is oriented upward, the cover having a plurality of openings for transmitting light.

13. The lighting fixture of claim 12, further comprising a resilient O-ring disposed around the circumferential edge.

14. The lighting fixture of claim 12, wherein the lamp comprises a sealed PAR lamp.

15. The lighting fixture of claim 12, wherein the lamp assembly further includes fastening means for retaining one or more filters over the lamp.

16. The lighting fixture of claim 15, wherein the fastening means comprises spacers for defining an air gap between the one or more filters and a face of the lamp.

17. The lighting fixture of claim 15, wherein the one or more filters comprises a diffuser and a color filter.

18. The lighting fixture of claim 12, wherein the housing and cover are formed from injection-molded thermoplastic polyester resin.

19. An in-ground lighting fixture, comprising:

a tubular housing having an inner surface having a pair of longitudinally extending channels that sildably receives the circular pivots, and upper end and a lower end;

a lamp assembly for retaining a lamp within the housing for projecting light upward through the upper end of the housing, the lamp assembly having a pair of circular pivots extending therefrom pivotably connected to the inner surface, the lamp assembly comprising a lamp housing and a retaining ring for retaining a lamp within the lamp housing, the retaining ring having an upper face with a plurality of fastening means extending therefrom for retaining one or more filters above a lamp face, the fastening means comprising a spacer for defining an air gap between the lamp face and the one or more filters; and a cover releasably attached to the upper end of the housing, the cover having a plurality of openings for transmitting light upward from the lamp.

* * * * *

UNITED STATES PATENT AND TRADEMARK OFFICE

CERTIFICATE OF CORRECTION

PATENT NO. : 7,320,533 B1
APPLICATION NO. : 11/367673
DATED : January 22, 2008
INVENTOR(S) : Joshua Z. Beadle It is certified that error appears in the above-identified patent and that said Letters Patent is hereby corrected as shown below:

In claim 19, column 8, line 41, please change “sildably” to --slidably--.

Signed and Sealed this

Twenty-seventh Day of May, 2008

JON W. DUDAS
*Director of the United States Patent and Trademark Office*